US008240185B2

(12) United States Patent
Jin et al.

(10) Patent No.: US 8,240,185 B2
(45) Date of Patent: Aug. 14, 2012

(54) METHOD FOR MANUFACTURING COVER OF ELECTRONIC DEVICE AND COVER OBTAINED THEREBY

(75) Inventors: Feng Jin, Shenzhen (CN); Gen-Ping Deng, Shenzhen (CN); Chun-Chi Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 629 days.

(21) Appl. No.: 12/495,685

(22) Filed: Jun. 30, 2009

(65) Prior Publication Data

US 2010/0263431 A1 Oct. 21, 2010

(30) Foreign Application Priority Data

Apr. 17, 2009 (CN) ..... 2009 1 0301639

(51) Int. Cl.
*B21D 41/00* (2006.01)
*B23D 23/00* (2006.01)

(52) U.S. Cl. ..... 72/370.1; 72/370.12; 72/379.4; 29/429

(58) Field of Classification Search ..... 72/57, 61, 72/370.1, 370.12, 370.13, 379.4; 29/421.1, 29/429

See application file for complete search history.

(56) References Cited

U.S. PATENT DOCUMENTS

| | | | | | |
|---|---|---|---|---|---|
| 2,355,792 | A * | 8/1944 | Franck | 72/339 |
| 2,421,629 | A * | 6/1947 | Langos | 72/356 |
| 3,643,322 | A * | 2/1972 | Gerstle | 219/67 |
| 3,754,429 | A * | 8/1973 | Creuzet | 72/342.4 |
| 5,676,012 | A * | 10/1997 | Ceriale | 72/294 |
| 5,829,133 | A * | 11/1998 | Joshi et al. | 29/890.043 |
| 6,666,734 | B2 * | 12/2003 | Fukatsu | 439/884 |
| 6,742,236 | B1 * | 6/2004 | Dion et al. | 29/434 |
| 7,584,639 | B2 * | 9/2009 | Boltshauser | 72/379.4 |
| 7,797,806 | B2 * | 9/2010 | Schwarz et al. | 29/421.1 |

* cited by examiner

*Primary Examiner* — David B Jones
(74) *Attorney, Agent, or Firm* — Altis Law Group, Inc.

(57) ABSTRACT

A method for manufacturing a cover of an electronic device includes steps of offering a metallic green piece comprising a top plate, a bottom plate and a connecting plate interconnecting a side of the top and bottom plates; offering a profile molding insert and a lower mold, the profile molding insert forming a shaping surface, the lower mold defining a cavity to receive an end of the green piece; putting the profile molding insert in the green piece, the shaping surface of the profiling molding insert being oriented towards the end of the green piece; inserting the end of the green piece in the cavity of the lower mold and punching the lower mold to enable the top and bottom plates at the end of the green piece bent along the shaping surface of the profile molding insert toward each other.

13 Claims, 5 Drawing Sheets

METHOD FOR MANUFACTURING COVER OF ELECTRONIC DEVICE AND COVER OBTAINED THEREBY

BACKGROUND

1. Technical Field

The present invention relates to a method for manufacturing a cover of an electronic device, and more particularly to a method for manufacturing a cover which is metallic. The present invention also relates to a cover of an electronic device obtained by the method.

2. Description of Related Art

Conventionally, a cover of an electronic device is made of plastic and has a rectangular configuration. However, this cover has no gloss and has a lower heat dissipation efficiency. It is difficult to meet requirements of an appearance and a heat dissipation efficiency of the cover.

For the foregoing reasons, there is a need in the art for a method for manufacturing a cover of an electronic device and a cover obtained by the method.

DETAILED DESCRIPTION

Figure 1:
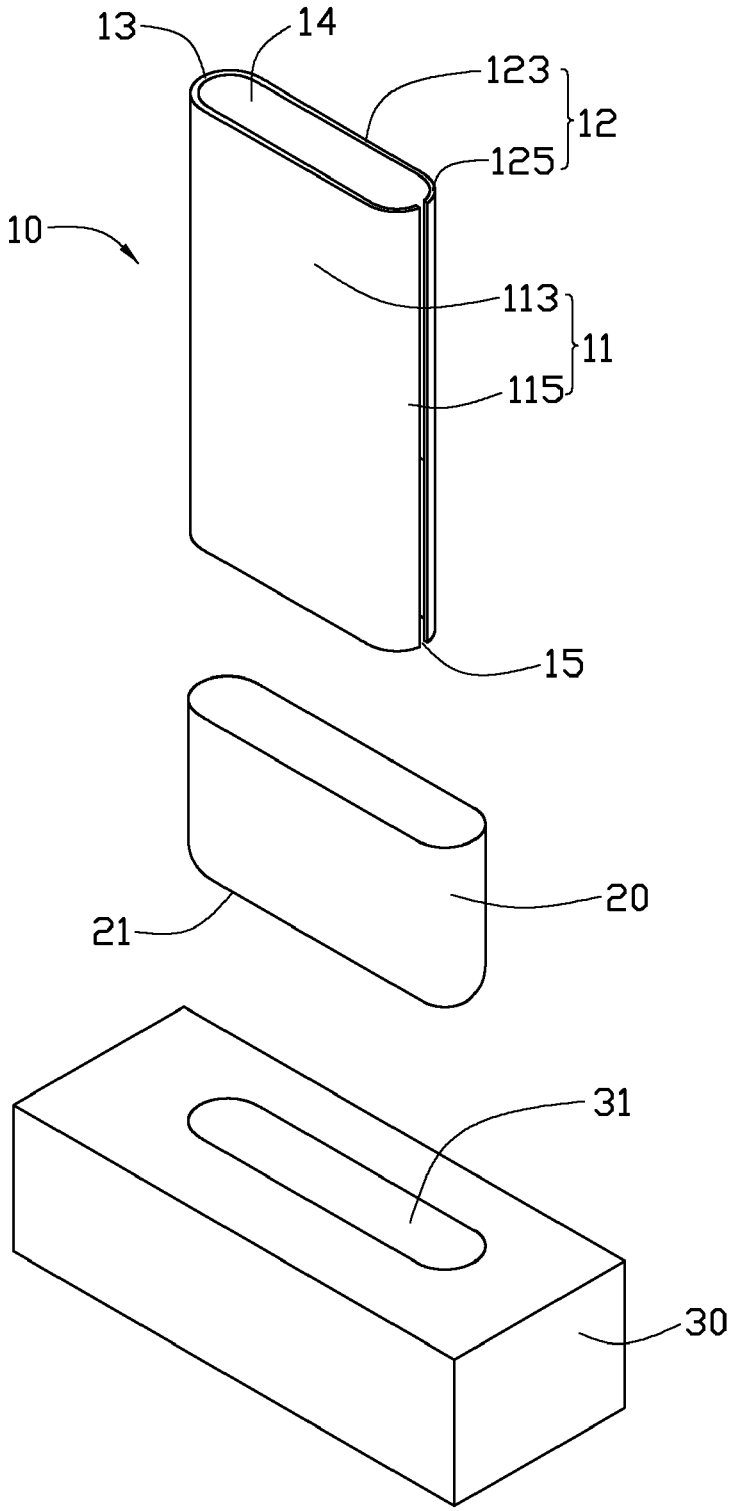
FIG. 1 is an exploded view of a green piece of a cover, a profile molding insert and a lower mold in accordance with a first embodiment of the present disclosure.
Figure 2:
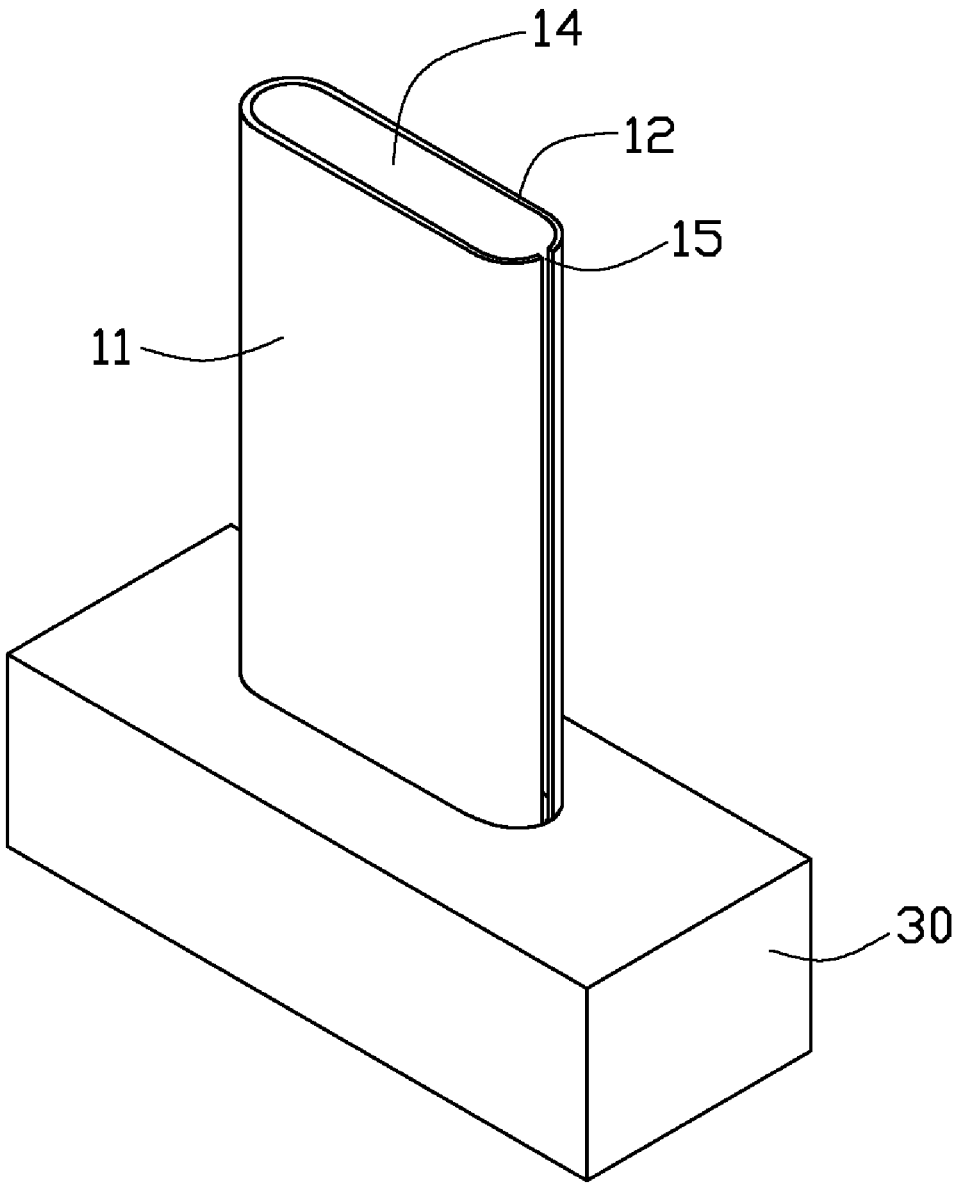
FIG. 2 is an assembled view of the green piece and the mold in FIG. 1.
Figure 3:
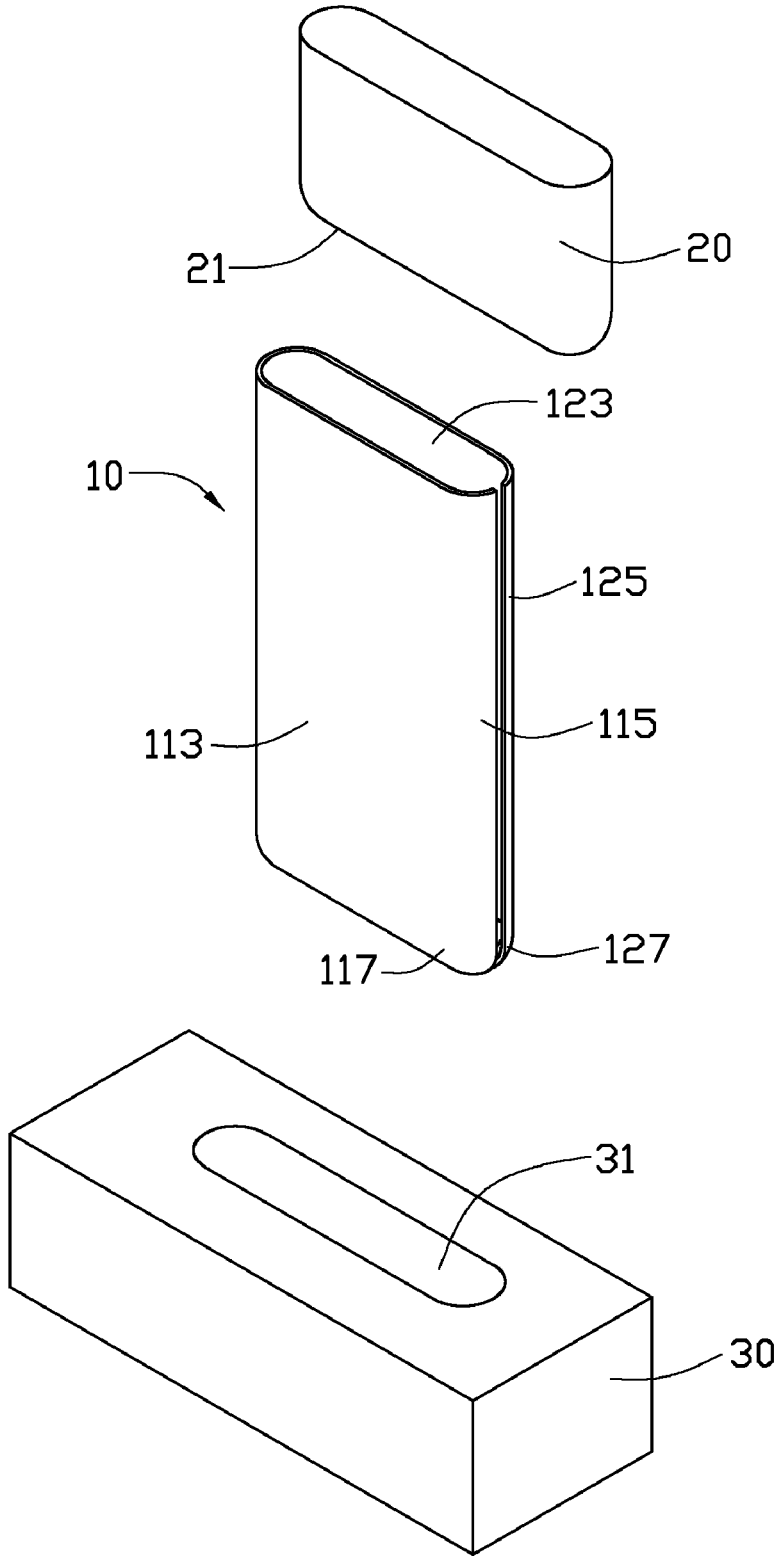
FIG. 3 is an exploded view similar to FIG. 1, but an end of the green piece is stamped.
Figure 4:
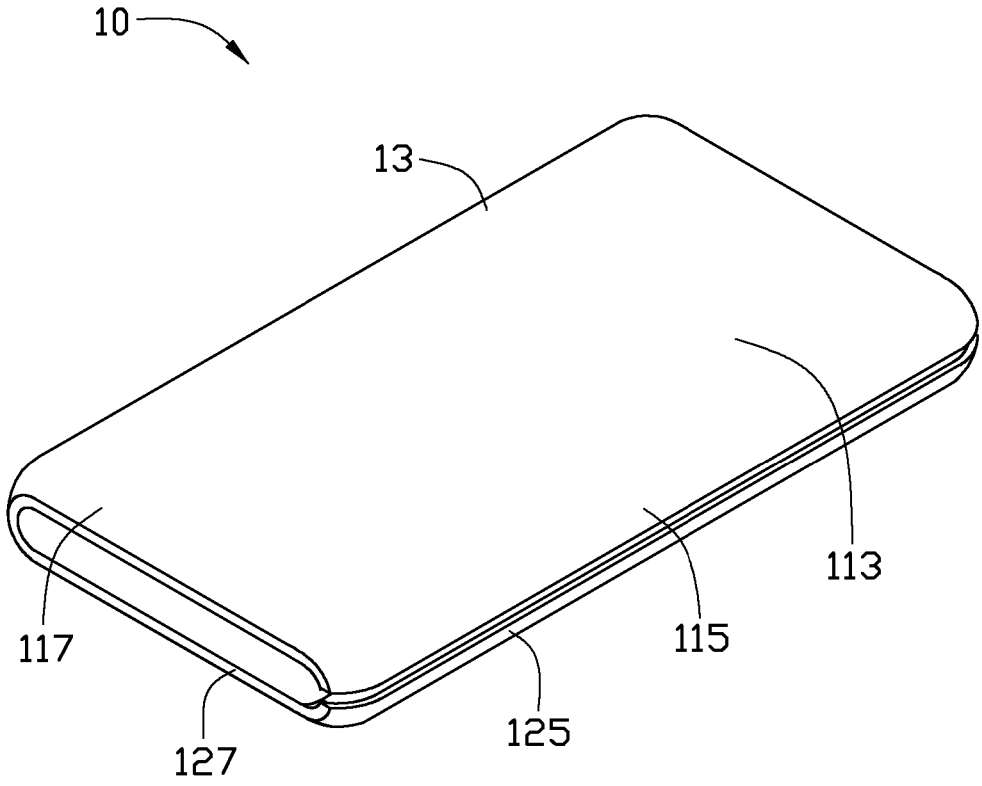
FIG. 4 is an isometric view of the cover.

Referring to FIGS. 1-2, a method for manufacturing a cover of an electronic device in accordance with a first embodiment of the present disclosure will be explained in the following. Firstly, a green piece 10 is provided. The green piece 10 has a flat, ring-shaped cross section with two opposite arc-shaped lateral sides and two opposite flat top and bottom sides. One (right one) of the arc-shaped opposite sides has an opening therein. The green piece 10 is metallic and comprises a top plate 11, a bottom plate 12 and a connecting plate 13. The top and bottom plates 11, 12 are spaced from each other. The connecting plate 13 is arc-shaped and interconnects lateral edges of the top and bottom plates 11, 12, respectively. The top plate 11 comprises a rectangular first connecting portion 113 connecting with a front edge of the connecting plate 13 and an arc-shaped first extending portion 115 extending outwardly from a lateral edge of the first connecting portion 1 13. The bottom plate 12 comprises a rectangular second connecting portion 123 connecting with a rear edge of the connecting plate 13 and an arc-shaped second extending portion 125 extending outwardly from a lateral edge of the second connecting portion 123. The first connecting portion 113 and the second connecting portion 123 are parallel to each other. Two first openings 14 are defined at a top end and a bottom end of the top and bottom plates 11, 12 of the green piece 10. Each of the first openings 14 is enclosed by the connecting plate 13, the top plate 11 and the bottom plate 12. Each of the first extending portion 115 and the second extending portion 125 has a convex outer surface and a concave inner surface opposite to the outer surface. The outer surfaces of the first extending portion 115 and the second extending portion 125 are oriented toward opposite directions. The inner surfaces of the first extending portion 115 and the second extending portion 125 face to and are spaced from each other. An elongated second opening 15 is defined between the first and second extending portions 115, 125, and extends throughout a length of the green piece 10.

Secondly, a profile molding insert 20 and a lower mold 30 are provided. The profile molding insert 20 is cubical and forms a convex shaping surface 21 at a bottom end thereof. A thickness of the profile molding insert 20 is smaller than or approaches a distance between the top and bottom plates 11, 12. The lower mold 30 is cubical and defines a cavity 31 at a central portion of a top end thereof. A shape of the cavity 31 is similar to that of the shaping surface 21 of the profile molding insert 20.

Thirdly, the profile molding insert 20 is inserted into the green piece 10 and sandwiched between the first connecting portion 113 and the second connecting portion 123. The shaping surface 21 is oriented towards one of the first openings 14 of the green piece 10. A corresponding end of the green piece 10 near to the shaping surface 21 is inserted in the cavity 31, and the green piece 10 is fixed to the lower mold 30.

Fourthly, a bottom end of the lower mold 30 is punched upwardly by a press head (not shown) toward the green piece 10. The lower mold 30 moves towards and presses the green piece 10 to enable bottom ends of the first and second connecting portions 113, 123 of the top and bottom plates 11, 12 to bend along the shaping surface 21 of the profile molding insert 20 until the bottom end of the first connecting portion 113 forms a first engaging portion 117 and the bottom end of the second connecting portion 123 forms a second engaging portion 127. Each of the first and second engaging portions 117, 127 has an arc-shaped configuration and has a convex outer surface and a concave inner surface opposite to the outer surface. The outer surfaces of the first and second engaging portions 117, 127 are oriented toward opposite directions. The inner surfaces of the first and second engaging portions 117, 127 face to and are spaced from each other. A distance between the first and second engaging portions 117, 127 is decreased from top to bottom.

Another end of the green piece 10 is manufactured by repeating the method previously described. Thus, opposite ends of the top plate 11 form the first engaging portions 117, respectively, and opposite ends of the bottom plate 12 form the second engaging portions 127, respectively.

Fifthly, the profile molding insert 20 is taken off from the green piece 10 and the first and second engaging portions 117, 127 are deburred. As a result, the desired cover is obtained.

Figure 5:
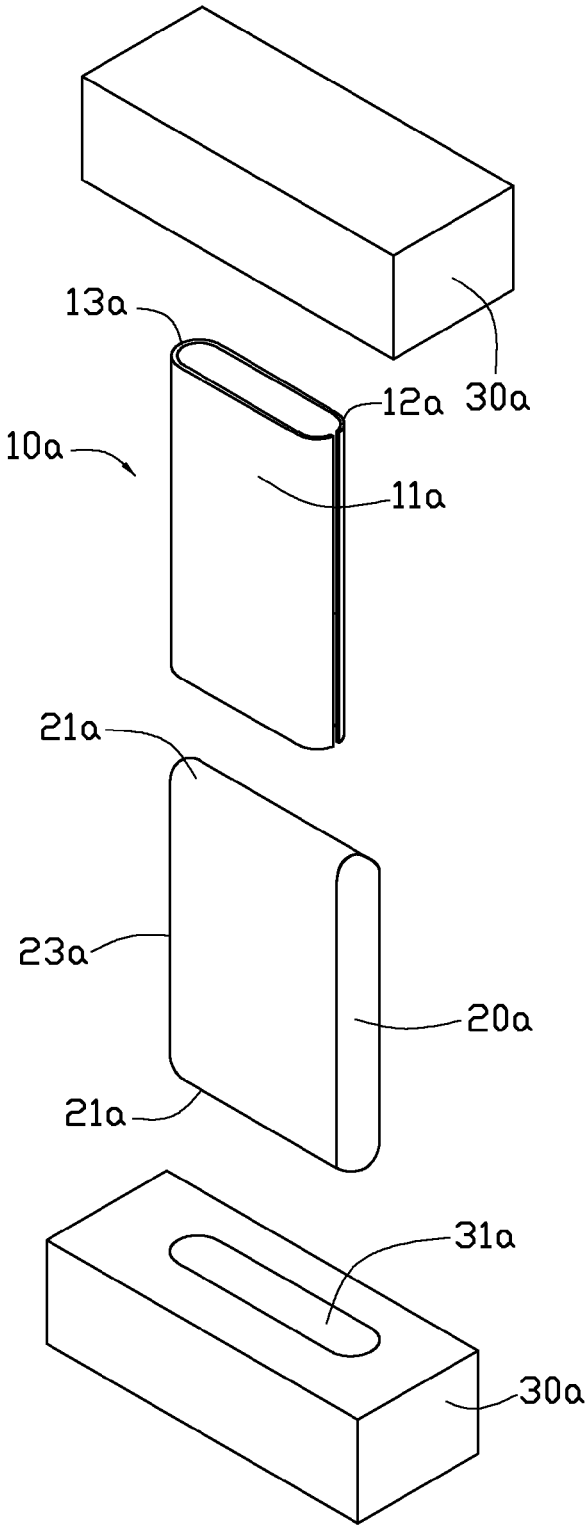
FIG. 5 is an exploded view of a green piece of a cover, a profile molding insert and upper and lower molds in accordance with a second embodiment of the present disclosure.

Referring to FIG. 5, a method for manufacturing the cover of the electronic device in accordance with a second embodiment of the present disclosure is similar to the first embodiment. Firstly, a metallic green piece 10*a* having a same configuration as that of the green piece 10 is provided. The green piece 10*a* is similar to the green piece 10 of the first embodiment and comprises a top plate 11*a*, a bottom plate 12*a* and a connecting plate 13*a* connecting with the top plate 11*a* and the bottom plate 12*a*. Each of the top plate 11*a* and the bottom plate 12*a* is flat and elongated.

Secondly, a profile molding insert 20*a* and upper and lower molds 30*a* are provided. The profile molding insert 20*a* is similar to the profile molding insert 20 of the first embodiment and longer than profile molding insert 20. The profile molding insert 20*a* has two first convex shaping surfaces 21*a* at top and bottom ends thereof and two second convex shaping surfaces 23*a* at lateral ends thereof. A length of the profile molding insert 20*a* is less than or approaches that of the green piece 10*a*. A width of the profile molding insert 20*a* is less than that of the top plate 11*a* and bottom plate 12*a*. A thickness of the profile molding insert 20*a* is smaller than or approaches a distance between the top and bottom plates 11*a*, 12*a*. Each of the upper and lower molds 30*a* has a configuration similar to that of the lower mold 30 of the first embodiment. A cavity 31*a* is defined at a central portion of an end of the lower mold 30*a* to receive an end of the green piece 10*a* therein. A length of the two cavities 31*a* is less than or approaches that of the green piece 10*a*.

Thirdly, the profile molding insert 20*a* is sandwiched between the top plate 11*a* and the bottom plate 12*a*. The first shaping surfaces 21*a* are oriented toward top and bottom ends of the green piece 10. The second shaping surfaces 23*a* are oriented toward lateral ends of the green piece 10. The top and bottom ends of the green piece 10 are inserted in the cavities 31*a* of the upper and lower molds 30*a* and the green piece 10*a* is fixed to the upper and lower molds 30*a*.

Fourthly, the upper and lower molds 30*a* are punched from opposite directions toward each other. The upper and lower molds 30*a* move toward and press the top and bottom ends of the green piece 10*a* to enable top and bottom ends of the top and bottom plates 11*a*, 12*a* to bend along the first shaping surfaces 21 of the profile molding insert 20*a* until each of the top and bottom ends of the top and bottom plates 11*a*, 12*a* form a first engaging portion 117 and a second engaging portion 127, respectively. Simultaneously, the upper and lower molds 30*a* press the lateral ends of the green piece 10*a* to enable the lateral ends of the green piece 10*a* of the top and bottom plates 11*a*, 12*a* to bend along the second shaping surface 23*a* until the lateral ends of the top and bottom plates 11*a*, 12*a* form a first extending plate 115, 125, respectively. As a result, the desired cover is obtained.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A method for manufacturing a cover of an electronic device comprising:

a) offering a green piece which is metallic and comprises a top plate, a bottom plate spaced from the top plate and a connecting plate interconnecting a side of the top plate and the bottom plate;

b) offering a profile molding insert and a lower mold, the profile molding insert forming a shaping surface at an end thereof, the lower mold defining a cavity to receiving an end of the green piece;

c) putting the profile molding insert into the green piece and between the top and bottom plates of the green piece, the shaping surface of the profiling molding insert oriented towards a first end of the green piece;

d) inserting the first end of the green piece in the cavity of the lower mold and punching the lower mold toward the green piece to make the lower mold move towards and press the green piece to enable the top and bottom plates at the first end of the green piece bent along the shaping surface of the profile molding insert toward each other.

2. The method as claimed in claim 1 further comprising a step e), wherein at the step e), the profile molding insert is putted in a second end of the green piece and the shaping surface is oriented towards the second end, the second end of the green piece is inserted in the cavity of the lower mold and the lower mold is punched toward the green piece to make top and bottom plates at the second end of the green piece bent along the shaping surface of the profile molding insert toward each other.

3. The method as claimed in claim 2 further comprising a step of taking off the profile molding insert from the green piece after step e).

4. The method as claimed in claim 1, wherein the shaping surface is convex and is formed at a bottom end of the profile molding insert, the first end of the top and bottom plates bent along the shaping surface of the profile molding insert to form a first engaging portion and a second engaging portion.

5. The method as claimed in claim 1, wherein each of the first and second engaging portions comprises an outer surface and an inner surface opposite to the outer surface, the outer surfaces of the first and second engaging portions are oriented toward opposite directions and the inner surfaces of the first and second engaging portions face to and are spaced from each other.

6. The method as claimed in claim 5, wherein a distance between the first and second engaging portions is decreased along an outward direction.

7. A method for manufacturing a cover of an electronic device comprising:

a) offering a green piece which is metallic and comprises a top plate, a bottom plate spaced from the top plate and a connecting plate interconnecting a lateral side of the top plate and the bottom plate;

b) offering a profile molding insert having a first shaping surface and a second shaping surface opposite the first shaping surface, c) offering a lower mold and an upper mold, the lower mold defining a first cavity to receive one end of the green piece, the upper mold defining a second cavity to receive another end of the green piece;

d) putting the profile molding insert between the top and bottom plates of the green piece with the first and second surfaces thereof engaging with two ends of the top and bottom plates of the green piece, respectively;

e) engaging an assembly of the green piece and the profile molding insert with the lower and upper molds, wherein the two ends of the top and bottom plates of the green piece are inserted in the first and second cavities of the lower and upper molds, respectively; and f) punching the lower and upper molds toward the green piece to make the first and second lower molds move toward and press the two ends of the top and bottom plates of the green piece to enable the two ends of the top and bottom plates bent along the first and second shaping surfaces of the profile molding insert.

8. The method as claimed in claim 7, wherein the first and second shaping surfaces are convex and are formed at bottom and top ends of the profile molding insert, respectively, two ends of the top plate are bent along the first shaping surfaces of the profile molding insert to form two first engaging portions, and two ends of the bottom plate are bent along the first shaping surfaces of the profile molding insert to form two second engaging portions.

9. The method as claimed in claim 8, wherein each of the first and second engaging portions comprises an outer surface and an inner surface opposite to the outer surface, the outer surfaces of the first and second engaging portions which are located at a corresponding end are oriented toward opposite directions and the inner surfaces of the first and second engaging portions which are located at a corresponding end face to and are spaced from each other.

10. The method as claimed in claim 7, wherein the profile molding insert further has a third shaping surface oriented towards another lateral side of the green piece away from the connecting plate, lateral ends of the top and bottom plates are pressed by inner surfaces of the cavities of the lower and upper molds to make the lateral ends bent along the third shaping surfaces of the profile molding insert at the step f), simultaneously.

11. The method as claimed in claim 10, wherein a length of the two cavities approaches that of the green piece.

12. The method as claimed in claim 10, wherein the third shaping surface is convex, and the lateral ends of the top and bottom plates are bent along the third shaping surface of the profile molding insert to form a third engaging portion and a fourth engaging portion, respectively.

13. The method as claimed in claim 12, wherein each of the third and fourth engaging portions comprises an outer surface and an inner surface opposite to the outer surface, the outer surfaces of the third and fourth engaging portions are oriented toward opposite directions and the inner surfaces of the third and fourth engaging portions face to and are spaced from each other.

* * * * *